US008154475B2

(12) United States Patent
Yang

(10) Patent No.: US 8,154,475 B2
(45) Date of Patent: Apr. 10, 2012

(54) PLASMA DISPLAY AND DRIVING METHOD THEREOF

(75) Inventor: Jin-Ho Yang, Suwon-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 824 days.

(21) Appl. No.: 12/081,300

(22) Filed: Apr. 14, 2008

(65) Prior Publication Data

US 2008/0272704 A1 Nov. 6, 2008

(30) Foreign Application Priority Data

May 3, 2007 (KR) ..... 10-2007-0043141

(51) Int. Cl.
*G09G 3/10* (2006.01)
*G09G 3/28* (2006.01)

(52) U.S. Cl. ..... 345/60; 315/169.1; 315/169.4

(58) Field of Classification Search ..... 345/52, 345/98, 102, 204, 208, 377, 379, 60–72, 345/94–97, 211; 315/169.1, 169.4
See application file for complete search history.

(56) References Cited

U.S. PATENT DOCUMENTS

| | | | | |
|---|---|---|---|---|
| 3,970,876 | A * | 7/1976 | Allen et al. | 326/32 |
| 4,529,965 | A * | 7/1985 | Lee | 341/122 |
| 4,675,588 | A * | 6/1987 | Talbot | 318/599 |
| 4,692,665 | A * | 9/1987 | Sakuma | 315/169.4 |
| 4,851,831 | A * | 7/1989 | Stern | 340/870.16 |
| 5,668,567 | A * | 9/1997 | Iwama | 345/60 |
| 5,757,342 | A * | 5/1998 | Hayashi | 345/60 |
| 6,072,447 | A * | 6/2000 | Noborio | 345/60 |
| 6,160,530 | A * | 12/2000 | Makino | 345/60 |
| 6,653,993 | B1 * | 11/2003 | Nagao et al. | 345/60 |
| 6,741,238 | B2 * | 5/2004 | Choi | 345/211 |
| 6,753,832 | B2 * | 6/2004 | Weitbruch et al. | 345/60 |
| 7,242,399 | B2 * | 7/2007 | Onozawa et al. | 345/212 |
| 7,532,178 | B2 * | 5/2009 | Lee | 345/60 |
| 7,583,240 | B2 * | 9/2009 | Yamashita et al. | 345/60 |
| 7,586,486 | B2 * | 9/2009 | Sasaki et al. | 345/204 |
| 7,633,467 | B2 * | 12/2009 | Cho et al. | 345/60 |
| 7,710,042 | B2 * | 5/2010 | Shiizaki et al. | 315/169.1 |

FOREIGN PATENT DOCUMENTS

| | | |
|---|---|---|
| JP | 2002-132208 | 5/2002 |
| JP | 2006-030527 | 2/2006 |
| JP | 2007-011193 | 1/2007 |
| JP | 2007-078719 | 3/2007 |
| KR | 10-2007-0017706 | 2/2007 |
| KR | 10-0769902 | * 10/2007 |

* cited by examiner

*Primary Examiner* — Quan-Zhen Wang
*Assistant Examiner* — Michael J Eurice
(74) *Attorney, Agent, or Firm* — Robert E. Bushnell, Esq.

(57) ABSTRACT

The present invention relates to a plasma display device and a driving method thereof. The plasma display device includes a first switch, and a second switch. The first switch has a first end electrically connected to a first power source that supplies a first voltage and a second end electrically connected to the plurality of first electrodes, and gradually increases a voltage of the plurality of first electrodes during a reset period. The second switch has a first end electrically connected to a second power source that supplies a second voltage that is less than the first voltage and a second end electrically connected to the plurality of first electrodes. The first and second switches are simultaneously turned on in the reset period.

12 Claims, 6 Drawing Sheets

PLASMA DISPLAY AND DRIVING METHOD THEREOF

CLAIM OF PRIORITY

This application makes reference to, incorporates the same herein, and claims all benefits accruing under 35 U.S.C. §119 from an application for PLASMA DISPLAY AND CONTROL METHOD THEREOF earlier filed in the Korean Intellectual Property Office on the 3rd of May 2007 and there duly assigned Serial No. 10-2007-0043141.

BACKGROUND OF THE INVENTION

1. Field of the Invention

The present invention relates to a plasma display and a driving method thereof. More particularly, the present invention relates to a plasma display having reduced power consumption, and a driving method thereof.

2. Description of the Related Art

A plasma display is a flat panel display that uses a plasma generated by a gas discharge to display characters or images. It includes, depending on its size, more than several scores to millions of discharge cells arranged in a matrix pattern.

Generally, in a plasma display, one frame is divided into respectively weighted subfields. Grayscales may be expressed by a combination of weights from among the subfields, which are used to perform a display operation. Each subfield includes a reset period, an address period, and a sustain period. The reset period is for initializing the status of each discharge cell, the address period is for selecting turned-on/turned-off cells, and the sustain period is for performing a sustain discharge on the turned-on cells so as to display an image.

In general, the plasma display increases a voltage and then decreases the increased voltage so as to reset a wall charge state of a discharge cell during the reset period. A current flows to a switch that is used for increasing the voltage and thus, a large amount of heat is generated, thereby causing errors or damage to the switch. In addition, a method of reducing the large power loss that occurs during the voltage increase is required.

SUMMARY OF THE INVENTION

The present invention has been made in an effort to provide a plasma display having a reduced power consumption, and a driving method thereof.

An exemplary plasma display according to one embodiment of the present invention includes a plurality of first electrodes, a first switch, and a second switch. The first switch has a first end electrically connected to a first power source that supplies a first voltage and a second end electrically connected to the plurality of first electrodes, and gradually increases a voltage of the plurality of first electrodes during a reset period. The second switch has a first end electrically connected to a second power source that supplies a second voltage that is less than the first voltage and a second end electrically connected to the plurality of first electrodes. The first and second switches are simultaneously turned on in the reset period.

An exemplary driving method according to another embodiment of the present invention drives a plasma display. The plasma display has a first switch connected between a first power source that supplies a first voltage and a plurality of first electrodes. The driving method includes during a reset period: increasing a voltage of the plurality of first electrodes to the first voltage by simultaneously turning on the first switch and a second switch that is connected between a second power source that supplies a second voltage that is less than the first voltage and the plurality of first electrodes; increasing the voltage of the plurality of first electrodes from the first voltage to the second voltage by turning on the first switch; and gradually decreasing the voltage of the plurality of first electrodes to a third voltage.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
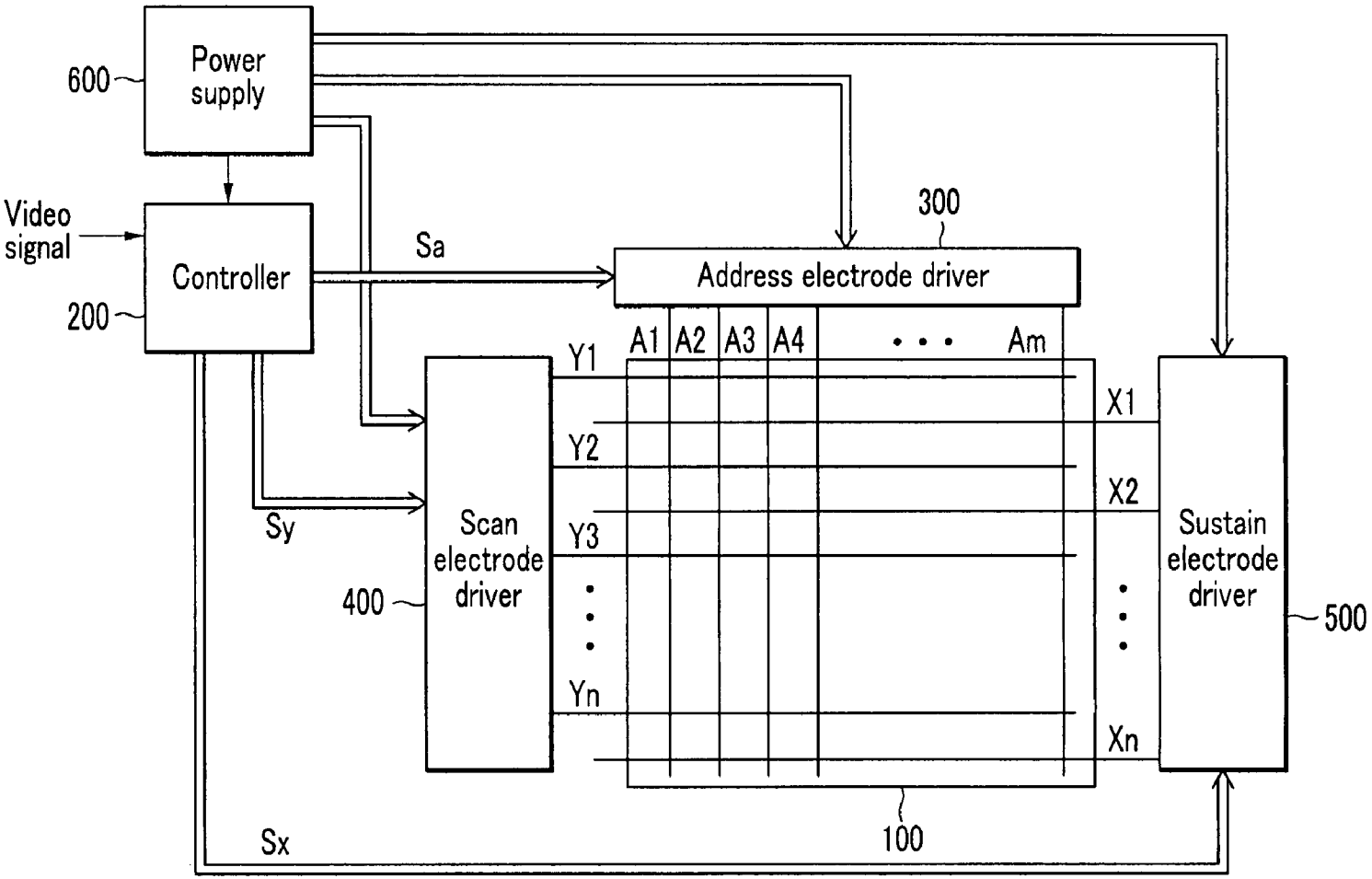
FIG. 1 is a block diagram of a plasma display according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise", and variations such as "comprises" and "comprising", will be understood to imply the inclusion of stated elements but not the exclusion of any other elements.

Throughout this specification and the claims that follow, the wall charge refers to a charge that is formed on a wall (for example, a dielectric layer) of the discharge cell close to the electrodes to be stored in the electrode. Even though the wall charge is not actually in contact with the electrode, hereinafter, it may be described that the wall charge is formed, accumulated, or stacked on the electrode.

When it is described in the specification that a voltage is maintained, it should not be understood to strictly imply that the voltage is maintained exactly at a predetermined voltage. To the contrary, even if a voltage difference between two points varies, the voltage difference is expressed to be maintained at a predetermined voltage in the case that the variance is within a range allowed in design constraints or in the case that the variance is caused due to a parasitic component that is usually disregarded by a person of ordinary skill in the art. In addition, since threshold voltages of semiconductor elements (e.g., a transistor and a diode) are very low compared to a discharge voltage, they are considered to be 0V.

Hereinafter, a plasma display and a driving method thereof according to an exemplary embodiment of the present invention is described in further detail with reference to the accompanying drawings.

FIG. 1 is a block diagram of a plasma display according to an exemplary embodiment of the present invention.

As shown in FIG. 1, the plasma display device includes a Plasma Display Panel (PDP) 100, a controller 200, an address electrode driver 300, a scan electrode driver 400, a sustain electrode driver 500, and a power supply 600.

The PDP 100 includes a plurality of address electrodes A1 to Am extending in a column direction, and a plurality of sustain electrodes X1 to Xn and a plurality of scan electrodes Y1 to Yn extending in a row direction as pairs. The sustain electrodes X1 to Xn are formed in correspondence with the respective scan electrodes Y1 to Yn, and respective ends thereof are coupled to each other. In addition, the PDP 100 includes a substrate in which the sustain and scan electrodes X1 to Xn and Y1 to Yn are arranged (not shown), and another substrate in which the address electrodes A1 to Am are arranged (not shown). The two substrates are placed facing each other with a discharge space therebetween so that the scan electrodes Y1 to Yn and the address electrodes A1 to Am perpendicularly cross each other and the sustain electrodes X1 to Xn and the address electrodes A1 to Am also perpendicularly cross each other. The discharge spaces formed at crossing regions of the address electrodes A1 to Am and the sustain and scan electrodes X1 to Xn and Y1 to Yn form discharge cells. This is an exemplary structure of the PDP 100, and PDPs having other structures can be applied to the present invention.

The controller 200 receives external video signals and outputs an address electrode driving control signal Sa, a sustain electrode driving control signal Sx, and a scan electrode driving control signal Sy. In addition, the controller 200 divides one frame into a plurality of subfields and drives the subfields, and each subfield includes a reset period, an address period, and a sustain period in a temporal manner.

The address electrode driver 300 receives the address electrode driving control signal Sa from the controller 200 and supplies a display data signal to each address electrode A1 to Am so as to select a discharge cell to be displayed.

The scan electrode driver 400 receives the scan electrode driving control signal Sy from the controller 200 and supplies a driving voltage to the scan electrodes Y1 to Yn.

The sustain electrode driver 500 receives the sustain electrode driving control signal Sx from the controller 200 and supplies a driving voltage to the sustain electrodes X1 to Xn.

The power supply 600 supplies power for driving the plasma display to the controller 200 and the respective drivers 300, 400, and 500.

Figure 2:
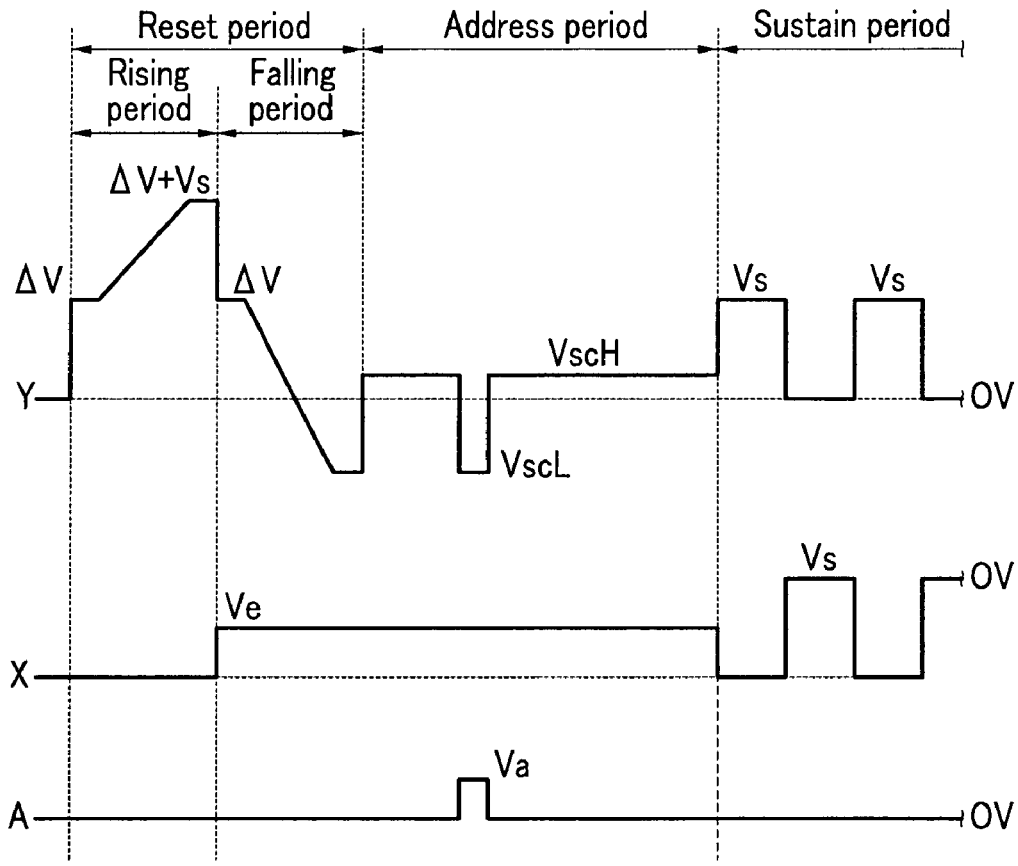
FIG. 2 includes driving waveforms of the plasma display according to the exemplary embodiment of the present invention.

FIG. 2 includes driving waveforms of the plasma display according to the exemplary embodiment of the present invention.

In FIG. 2, one subfield among a plurality of subfields is illustrated and a driving waveform supplied to a scan electrode Y, a sustain electrode X, and an address electrode A forming one cell is described below for convenience of description.

The reset period includes a rising period and a falling period. During the rising period, a voltage of the scan electrode Y is gradually increased from a voltage ΔV to a voltage (ΔV+Vs) while the address electrode A and the sustain electrode X are maintained at a reference voltage (i.e., 0V in FIG. 2, and hereinafter the reference voltage corresponds to 0V). A weak discharge is generated between the scan electrode and the sustain electrode X and between the scan electrode Y and the address electrode A so that negative (−) wall charges are formed on the scan electrode Y and positive (+) wall charges are formed on the sustain electrode X and the address electrode A. Since all cells need to be reset during the reset period, the voltage (ΔV+Vs) is set to a voltage that is high enough to cause a discharge in all of the cells under any condition.

During the rising period of the reset period, a large amount of current flows to a switch used for increasing the voltage of the scan electrode Y and thus a large amount of heat is generated by the switch. Accordingly, a possibility of damage to the switch is increased and a large amount of power is lost during the increase of the voltage of the scan electrode Y. The scan electrode driver 400 according to the exemplary embodiment of the present invention reduces the amount of current flowing to the switch that is used during the rising period of the reset period so that damage to the switch and power loss due to heat can be significantly reduced, and this is described in further detail later.

During the falling period, the voltage of the scan electrode Y is gradually decreased from the voltage ΔV to a voltage VscL while the address electrode A and the sustain electrode X are maintained at the reference voltage and a voltage Ve. A weak discharge is generated between the scan electrode Y and the sustain electrode X and between the scan electrode Y and the address electrode A so that the negative (−) wall charges formed on the scan electrode and the positive (+) wall charges formed on the sustain electrode X and the address electrode A during the rising period are erased. In general, a voltage (VscL−Ve) is set close to a discharge firing Vf voltage between the scan electrode Y and the sustain electrode X, and accordingly, a wall voltage difference between the scan electrode Y and the sustain electrode X becomes close to 0V so that a cell that has not experienced an address discharge during the address period can be prevented from experiencing a misfiring.

During the address period, a scan pulse having the voltage VscL (i.e., the scan voltage) is sequentially supplied to the plurality of scan electrodes Y1 to Yn while the sustain electrode X is supplied with the voltage Ve so as to select light emitting cells. Simultaneously, an address voltage is supplied to an address electrode A that passes a light emitting cell among a plurality of cells formed by the scan electrode Y to which the voltage VscL is supplied. Then, an address discharge is generated between the address electrode A to which the address voltage is supplied and the scan electrode Y to which the voltage VscL is supplied and between the scan electrode Y to which the voltage VscL is supplied and a sustain electrode X that corresponds to the scan electrode Y to which the voltage VscL is supplied. Accordingly, positive (+) wall charges are formed on the scan electrode Y and negative (−) wall charges are formed on the address electrode A and the sustain electrode X, respectively. A scan electrode Y to which the voltage VscL is not supplied is supplied with a voltage VscH (i.e., a non-scan voltage) that is higher than the voltage VscL, and an address electrode A of an unselected discharge cell is supplied with the reference voltage.

During the sustain period, a sustain pulse having a high level voltage (Vs in FIG. 2) and a low level voltage (0V in FIG. 2) is alternately supplied in reverse phases to the scan electrode Y and the sustain electrode X. Thus, 0V is supplied to the sustain electrode X when the voltage Vs is supplied to the scan electrode Y and 0V is supplied to the scan electrode Y when the voltage Vs is supplied to the sustain electrode X, and a discharge is generated in the scan electrode Y and the sustain electrode X by a wall voltage formed between the scan electrode Y and the sustain electrode X due to the address discharge and the voltage Vs. Then, an operation for supplying sustain pulses to the scan electrode Y and the sustain electrode X is repeated a number of times corresponding to a weight of the corresponding subfield.

Hereinafter, the scan electrode driver 400 according to the exemplary embodiment of the present invention is described in further detail with reference to FIG. 3. The scan electrode driver 400 according to the exemplary embodiment of the present invention includes a plurality of driving circuits for realizing the driving waveforms of FIG. 2, and only a portion for generating the driving waveform of the reset period of FIG. 3. In addition, although the switch is illustrated as an N-channel Field Effect Transistor (FET) having a body diode (not shown) in FIG. 3, another switch that performs a function that is similar to or the same as that of the FET can also be used. Furthermore, a capacitive component formed by the sustain electrode X and the scan electrode Y is illustrated as a panel capacitor Cp.

Figure 3:
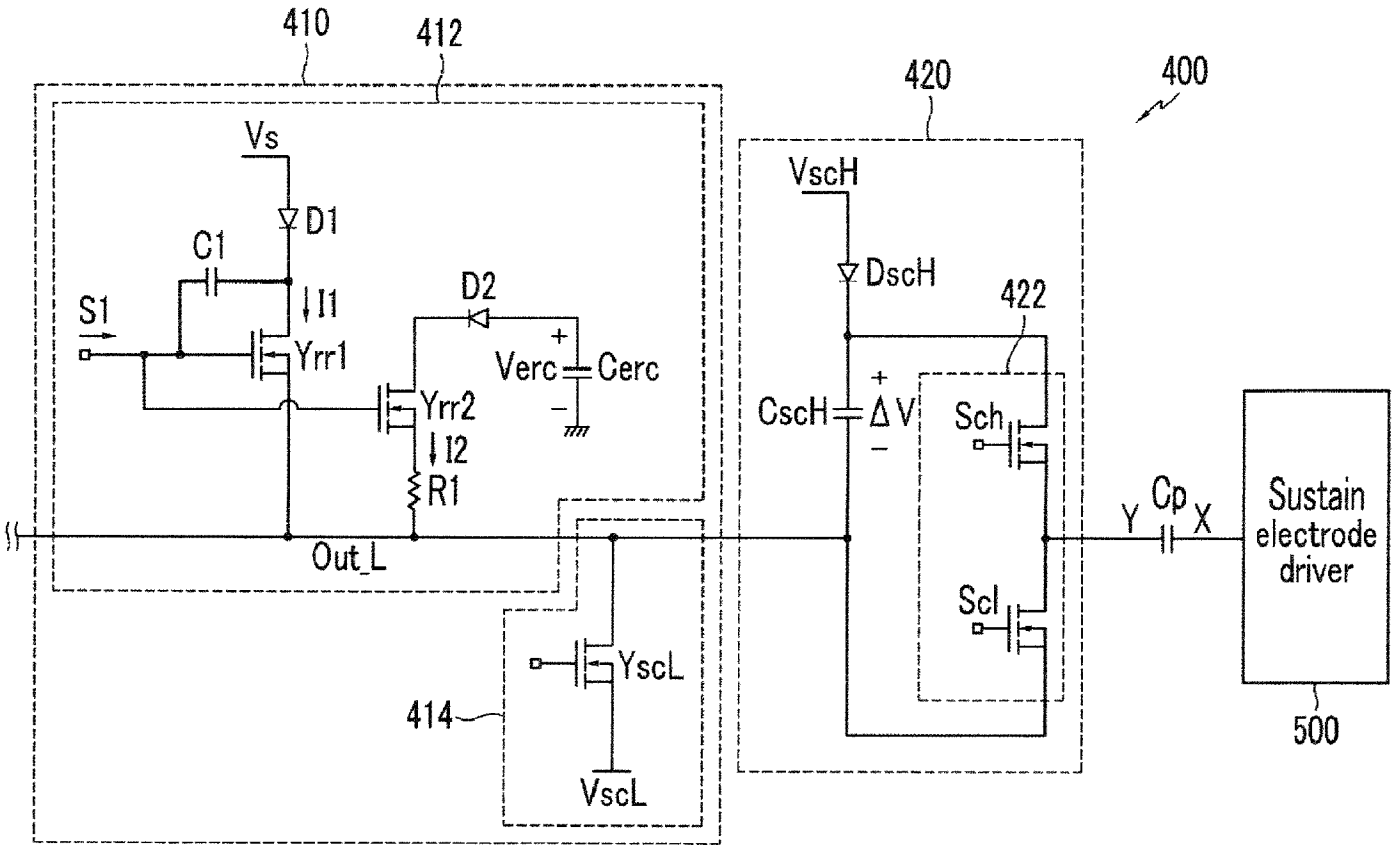
FIG. 3 is a circuit diagram of a scan electrode driver according to the exemplary embodiment of the present invention.

FIG. 3 is a circuit diagram of a scan electrode driver 400 according to an exemplary embodiment of the present invention.

As shown in FIG. 3, the scan electrode driver 400 includes a reset driver 410 and a scan driver 420.

The reset driver 410 includes a rising reset pulse generator 412 and a falling reset pulse generator 414.

The rising reset pulse generator 412 includes transistors Yrr1 and Yrr2, diodes D1 and D2, capacitors C1 and Crec, and a resistor R1.

An anode of the diode D1 is connected to a power source that supplies the voltage Vs. A drain of the transistor Yrr1 is connected to a cathode of the diode D1, and a source of the transistor Yrr1 is connected to an Out_L line. The capacitor C1 is connected between the drain and a gate of the transistor Yrr1. The capacitor Cerc has a first end connected to a ground and a second end connected to an anode of the diode D2. A drain of the transistor Yrr2 is connected to a cathode of the diode D2, and the resistor R1 has a first end connected to a source of the transistor Yrr2 and a second end connected to the Out_L line. The capacitor Cerc may be a power recovery capacitor included in an energy recovery circuit (not shown), and a voltage Verc charged in the capacitor Cerc is a voltage that is less than the voltage ΔV and greater than the reference voltage (0V in FIG. 2). In addition, the transistor Yrr1 and the transistor Yrr2 are simultaneously turned on/off by a control signal S1 from the controller 200 of FIG. 1.

The capacitor C1 increases the voltage of the scan electrode Y from the voltage ΔV to a voltage Vset in a ramp waveform pattern. That is, the capacitor C1 turns off the transistor Yrr1 when a gate-drain voltage of the transistor Yrr1 is suddenly increased, and increases the amount of current flowing through the transistor Yrr1 when the gate-drain voltage of the transistor Yrr1 is maintained at a constant level within a predetermined range. Therefore, the transistor Yrr1 acts as a voltage controlling transistor that is controlled on the basis of the gate-drain voltage. In addition, the resistor R1 connected to the source of the transistor Yrr2 reduces a gate-source voltage of the transistor Yrr2 when the current flowing through the transistor Yrr2 is increased so as to prevent the amount of current flowing through the transistor Yrr2 from exceeding a predetermined level. Therefore, the transistor Yrr2 acts as a constant current switch. In addition, the diode D1 blocks the inflow of a reverse-direction current through body diodes of the transistors Yrr1 and Yrr2. Although the resistor R1 is illustrated to make the transistor Yrr2 act as a constant current switch in FIG. 3, another circuit elements that perform a function that is similar to or the same as that of the resistor R1 can also be used.

The rising reset pulse generator 412 according to the exemplary embodiment of the present invention further includes the transistor Yrr2, the resistor R2, the diode D2, and the capacitor Cerc, in addition to the constituent elements of a typical reset pulse generator. Therefore, the scan electrode driver 400 according to the exemplary embodiment of the present invention can significantly reduce a power loss and damage of the transistor due to heat compared to a typical scan electrode driver that generates a rising reset pulse by using only one transistor Yrr1, and this is described later in further detail.

The falling reset pulse generator 414 includes a transistor YscL having a drain connected to the Out_L line and a source connected to a power source that supplies the voltage VscL.

The scan driver 420 includes a diode DscH, a capacitor CscH, and a selection circuit 422. The diode DscH has an anode connected to a power source that supplies the voltage VscH. A first end of the capacitor CscH is connected to a cathode of the diode DscH and a second end connected to the out_L line.

The selection circuit 422 includes transistors Sch and Scl. The transistor Sch has a drain connected to a node of the diode DscH and the capacitor CscH and a source connected to the scan electrode Y. The transistor Scl has a drain connected to the scan electrode Y and a source connected to the Out_L line. The selection circuit 422 supplies the voltage VscL to the scan electrode Y for selecting a turn-on cell in the address period, and supplies the voltage VscH to the scan electrode Y of a turn-off cell. In general, the selection circuit 422 is connected to each of the plurality of scan electrodes Y1 to Yn in an IC form so as to sequentially select the plurality of scan electrodes Y1 to Yn in the address period, and a driving circuit of the scan electrode driver 400 is commonly connected to the plurality of scan electrodes Y1 to Yn through such a selection circuit 422. In FIG. 3, one scan electrode Y and one selection circuit 422 corresponding to the scan electrode Y are illustrated.

Hereinafter, a driving operation of the scan electrode driver 400 of FIG. 3 according to the exemplary embodiment of the present invention is described in further detail with reference to FIG. 4 to FIG. 5.

Figure 4A:
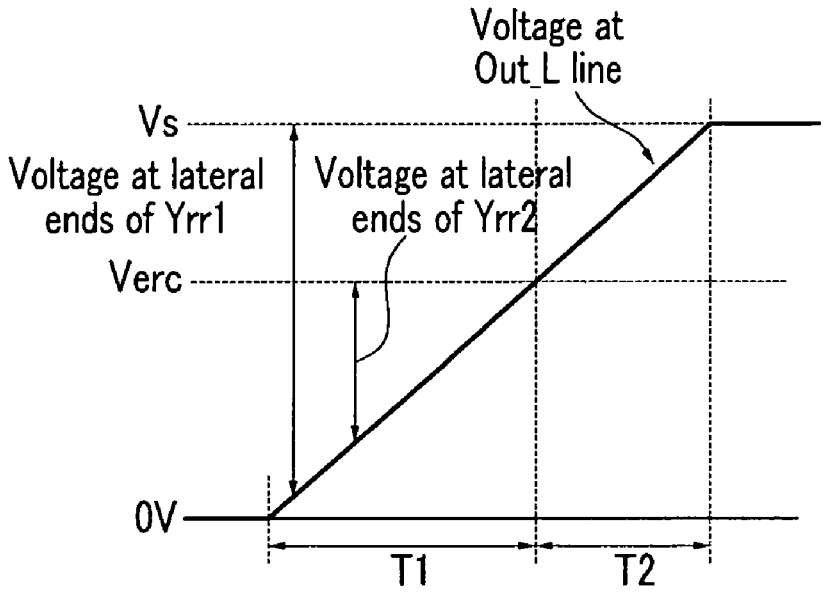
FIG. 4A is a graph of a change in a voltage of an Out_L line during a rising period of a reset period.
Figure 4B:
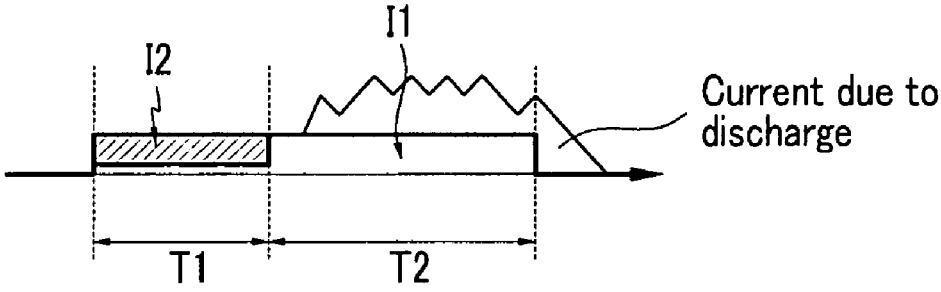
FIG. 4B is a graph of the amount of current flowing to transistors during the rising period of the reset period.
Figure 4C:
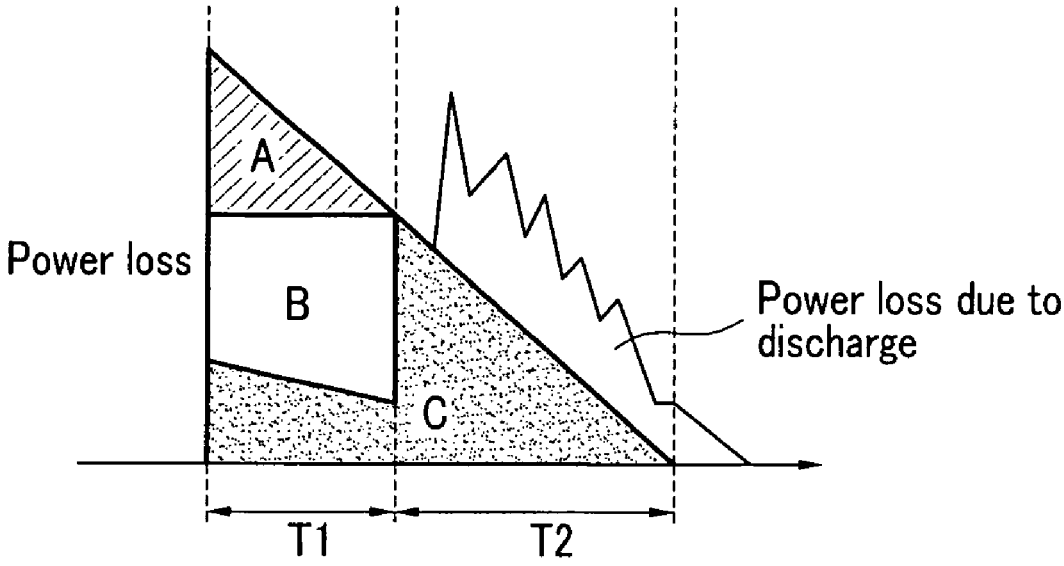
FIG. 4C is a graph of a power loss during the rising period of the reset period.
Figure 5:
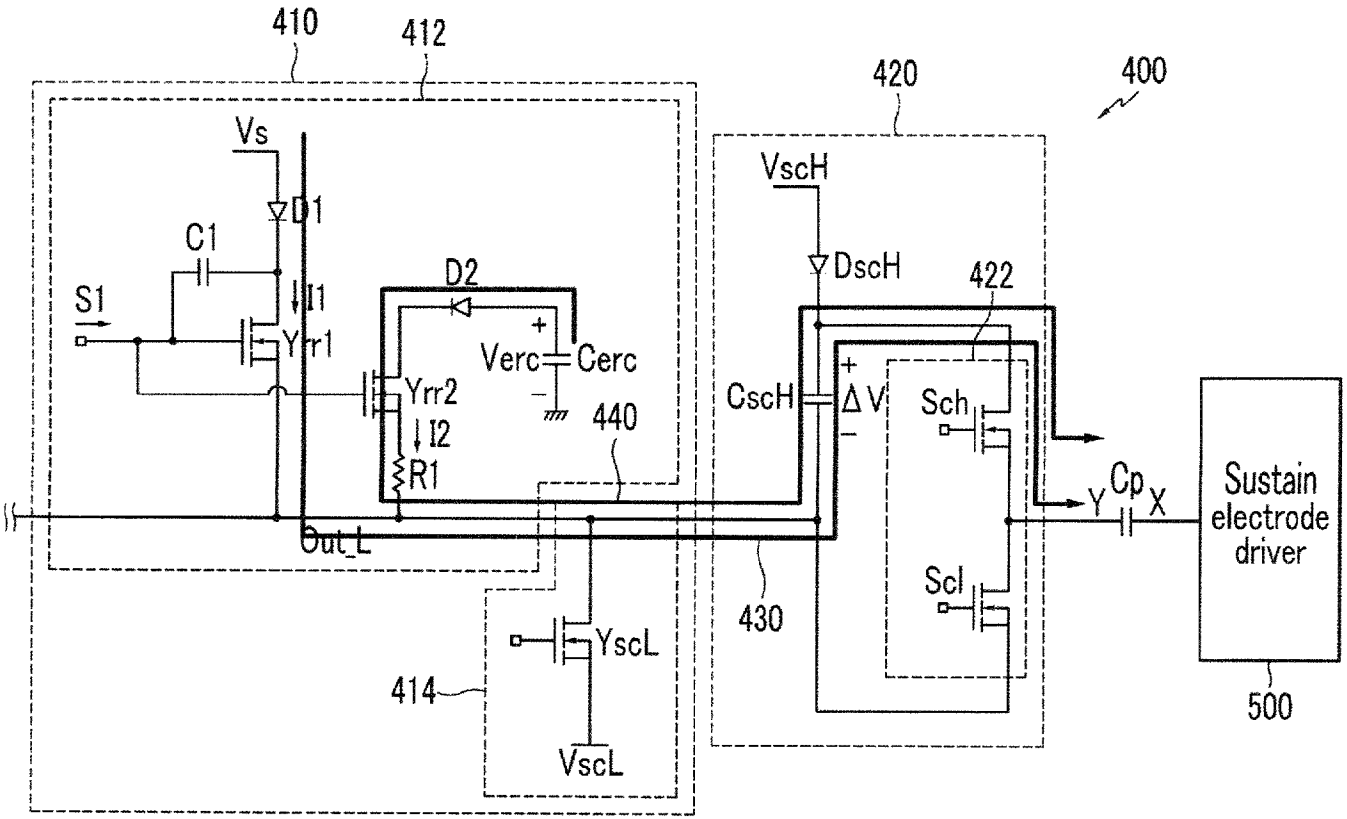
FIG. 5 is a circuit diagram including a first current path and a second current path formed for realizing a driving waveform of a rising period of a reset period of FIG. 2 by using the scan electrode driver according to the exemplary embodiment of the present invention.

FIG. 4A shows a change in a voltage of the Out_L line during the rising period of the reset period, and FIG. 4B shows the amount of current flowing through the transistors Yrr1 and Yrr2 during the rising period of the reset period. In addition, FIG. 4C shows a low loss during the rising period of the reset period. FIG. 5 shows a first current path 430 and a second current path 440 formed for realizing the driving waveform of the rising period of the reset period of FIG. 2 by using the scan electrode driver 400 according to the exemplary embodiment of the present invention.

In FIG. 4B, I1 and I2 respectively denote currents flowing through the transistor Yrr1 and the transistor Yrr2. In addition, in FIG. 4C, the region A denotes the amount of power loss due to the transistor Yrr2, and the region C denotes the amount of power loss due to the transistor Yrr1. In addition, the region B denotes a decrease of the amount of power loss due to the use of the scan electrode driver 400 according to the exemplary embodiment of the present invention. It is assumed in the following description that the transistors YscL and Sch are turned on before a period T1 and thus a voltage (VscH−VscL) (i.e., a voltage ΔV) charged to the capacitor CscH is supplied to the scan electrode, and the transistor YscL is turned off at the start of the period T1 so that a voltage of the second end of the capacitor (CscH) (i.e., a voltage of the Out_L line) is increased to the reference voltage (0V in FIG. 4).

The period T1 is a period during which the transistors Yrr1 and Yrr2 are maintained in a turned-on state.

At the time that the period T1 is started, the transistors Yrr1 and Yrr2 are simultaneously turned on according to the control signal S1 of the controller 200 of FIG. 1. When the transistor Yrr1 is turned on, a first current path 430 is formed from the power source that supplies the voltage Vs through the diode D1, the transistor Yrr, the capacitor CscH, and the transistor Sch to the scan electrode Y. In addition, when the transistor Yrr2 is turned on, a second current path 440 is formed from the capacitor Cerc charged with the voltage Verc through the diode D2, the transistor Yrr2, the resistor R1, the capacitor CscH, and the transistor Sch to the scan electrode Y.

That is, a current flows to the scan electrode Y through the first and second current paths 430 and 440 simultaneously via the capacitor CscH so that the voltage of the Out_L line is gradually increased from the reference voltage in a ramp waveform pattern as shown in FIG. 4A. In this case, the voltage of the scan electrode Y corresponding to the voltage of the Out_L line is also gradually increased from the voltage ΔV.

At the time that the period T1 is started, the drain and the source of the transistor Yrr1 have a large voltage difference as shown in FIG. 4A. The scan electrode driver 400 according to the exemplary embodiment of the present invention divides the current to the first and second current paths 430 and 440 formed by simultaneously turning on the two transistors Yrr1 and Yrr2 at the time that the period T1 is started. Accordingly, the amount of current flowing through the transistor Yrr1 is reduced so that the transistor Yrr1 can be prevented from being erroneously operated or damaged due to heat generated therefrom. In addition, the power loss during the rising period of the reset period can be significantly reduced as the amount of current flowing through the transistor Yrr1 is decreased. That is, in FIG. 4C, when a rising reset pulse is generated by using one transistor Yrr1, the amount of power consumed by the transistor Yrr1 is as high as a sum of the regions A, B, and C. On the contrary, the scan electrode driver 400 according to the exemplary embodiment of the present invention divides the current through the transistors Yrr1 and Yrr2, and therefore, the amount of power consumption of the transistor Yrr1 and the amount of power consumption of the transistor Yrr2 respectively correspond to the region C and the region A, thereby reducing an amount of power consumption that corresponds to the region B.

A period T2 is a period during which the voltage of the Out_L line is increased from the voltage Verc to the voltage Vs. That is, during the period T2, the voltage of the scan electrode Y is increased from the voltage Verc to the voltage ΔV+Vs. When the voltage of the Out_L line is increased to the voltage Verc during the period T1, the transistor Yrr2 is turned off and only the transistor Yrr1 is maintained in the turned-on state so that the period T1 is terminated and the period T2 is started.

Since only the transistor Yrr1 is maintained in the turned-on state during the period T2, the current flows only through the transistor Yrr1 as shown in FIG. 4B. In addition, as shown in FIG. 4C, only the transistor Yrr1 consumes power. During the period T2, the voltage of the scan electrode Y is increased so that a voltage difference between the scan electrode Y and the sustain electrode X and a voltage difference between the scan electrode Y and the address electrode A become greater than the discharge firing voltage Vf, thereby causing a weak discharge to be generated. FIG. 4B and FIG. 4C show a change in the amount of current flowing through the transistor Yrr1 and a power loss due to the weak discharge.

When the voltage of the scan electrode Y reaches the voltage (ΔV+Vs) (i.e., when the voltage of the Out_L line is increased to the voltage Vs), the transistor Yrr1 is turned off.

The scan electrode driver 400 according to the exemplary embodiment of the present invention turns on the transistor Yrr2 at an early rising period of the reset period where a voltage difference at the lateral ends of the transistor Yrr1 is high so that the current can simultaneously flow through the two transistors Yrr1 and Yrr2 during the period T1, thereby reducing power consumption of the scan electrode driver 400 and preventing damage to a circuit element due to heat.

As described, the plasma display device according to the exemplary embodiment of the present invention can prevent errors or damage to the switch due to a large amount of heat, and can be driven with low power to reduce a power loss.

While the present invention has been described in connection with what is presently considered to be practical exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A plasma display comprising:

a plurality of first electrodes;

a first switch having a first end electrically connected to a first power source supplying a first voltage, a second end electrically connected to the plurality of first electrodes, and having a control end receiving a control signal, and having a capacitor connected between the first end and the control end; and a second switch having a first end electrically connected to a second power source supplying a second voltage less than the first voltage and having a second end electrically connected to the plurality of first electrodes;

wherein the first and second switches are simultaneously turned on to gradually increase a voltage of the plurality of first electrodes to a third voltage corresponding to the second voltage in a first period of the reset period, and the first switch is maintained to be turned on and the second switch is turned off to gradually decrease the voltage of the plurality of first electrodes from the third voltage to a fourth voltage corresponding to the first voltage in a second period of the reset period.

2. The plasma display of claim 1, wherein the first and second switches are turned on/off by the same control signal.

3. The plasma display of claim 1, wherein the second switch is a constant current switch.

4. The plasma display of claim 3, further comprising a resistor connected between the second end of the second switch and the plurality of first electrodes to control the amount of current flowing through the second switch to be constant.

5. The plasma display of claim 4, further comprising:

a first diode having an anode connected to the first power source and a cathode connected to a first end of the first switch; and a second diode having an anode connected to the second power source and a cathode connected to the first end of the second switch.

6. The plasma display of claim 5, wherein the first voltage is a high level voltage supplied to the plurality of first electrodes during a sustain period and the second voltage is half that of the first voltage.

7. The plasma display of claim 5, wherein the second power source comprises a power recovery capacitor.

8. A method of driving a plasma display having a first switch connected between a first power source supplying a first voltage and a plurality of first electrodes and a second switch connected between a second power source supplying a second voltage and the plurality of first electrodes, the first switch further having a capacitor connected between a gate and a drain, the driving method comprising during a reset period:

increasing a voltage of the plurality of first electrodes to a fourth voltage corresponding to the second voltage by simultaneously turning on the first switch and the second switch during a first period of the reset period, said second voltage being less than the first voltage;

decreasing the voltage of the plurality of first electrodes from the fourth voltage to a fifth voltage corresponding to the first voltage during a second period of the reset period, wherein by turning on the first switch is maintained to be turned-on and the second switch is turned off in the second period; and gradually decreasing the voltage of the plurality of first electrodes to a third voltage.

9. The driving method of claim 8, wherein the first voltage is a high level voltage supplied to the plurality of first electrodes during a sustain period, and the third voltage is a scan voltage sequentially supplied to the plurality of first electrodes during an address period.

10. The driving method of claim 8, wherein the second voltage is half that of the first voltage.

11. The driving method of claim 8, wherein the fourth voltage is equal to a summation of the second voltage and a sixth voltage, and the fifth voltage is equal to a summation of the first voltage and the sixth voltage.

12. The plasma display of claim 1, wherein the third voltage is equal to a summation of the second voltage and a fifth voltage, and the fourth voltage is equal to a summation of the first voltage and the fifth voltage.

* * * * *